United States Patent [19]

Sakamoto et al.

[11] Patent Number: 4,776,083

[45] Date of Patent: Oct. 11, 1988

[54] APPARATUS FOR MOUNTING A SIPHON TAPPING TUBE ONTO A CONVERTER VESSEL

[75] Inventors: Manabu Sakamoto; Satoshi Tatsuta, both of Kobe; Akira Murata, Gifu; Natsuki Namura, Kurashiki; Shigeki Tamada, Kurashiki; Yoshinori Kawasaki, Kurashiki; Norio Misaki, Kurashiki, all of Japan

[73] Assignee: Kawasaki Jukogyo Kabushiki Kaisha, Kobe, Japan

[21] Appl. No.: 28,442

[22] Filed: Mar. 20, 1987

[30] Foreign Application Priority Data

Mar. 22, 1986 [JP] Japan ..... 61-64403

[51] Int. Cl.[4] ..... B23P 21/00

[52] U.S. Cl. ..... 29/721; 29/824

[58] Field of Search ..... 29/526 R, 720, 721, 29/824

[56] References Cited

U.S. PATENT DOCUMENTS

| | | | |
|---|---|---|---|
| 3,872,566 | 3/1975 | Pedroth | 29/721 X |
| 4,274,622 | 6/1981 | Ohmori . | |
| 4,290,306 | 9/1981 | Murakami et al. . | |
| 4,707,663 | 10/1987 | Mischlle | 901/16 X |

FOREIGN PATENT DOCUMENTS

| | | | |
|---|---|---|---|
| 1479445 | 5/1967 | France . | |
| 61-4509 | 2/1986 | Japan . | |
| 57-154750 | 2/1986 | Japan . | |
| 556024 | 1/1977 | U.S.S.R. | 29/824 |
| 560728 | 6/1977 | U.S.S.R. | 29/824 |
| 709428 | 1/1980 | U.S.S.R. | 29/824 |
| 2066438 | 7/1981 | United Kingdom . | |

OTHER PUBLICATIONS

Technical Differences Between the Prior art and the Present Invention used.

*Primary Examiner*—Timothy V. Eley

*Attorney, Agent, or Firm*—Poms, Smith, Lande & Rose

[57] ABSTRACT

An apparatus for mounting a siphon tapping tube onto a tap hole mounting part of a converter vessel has a lower car and an upper car, which are placed on a ladle car which travels beneath a converter vessel, the lower car and the upper car being capable of travelling in the direction of the travel of the ladle car and in the direction perpendicular to that of the travel of the ladle car, respectively, a loading table mounted on the upper car, which is guided by an upright support frame and being capable of moving upward and downward with a siphon tapping tube loaded on the table, and bolt tightening and untightening units which are provided on the loading table in positions corresponding to the respective bolt hole set positions in the flange of the siphon tapping tube and are capable of receiving mounting bolts. TV camera is provided on the upper car, allowing the operator to monitor the tap hole mounting part.

2 Claims, 2 Drawing Sheets

Fig. 3.
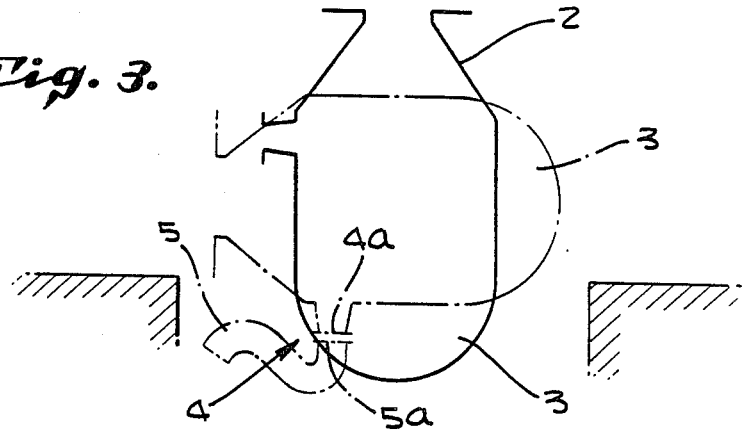
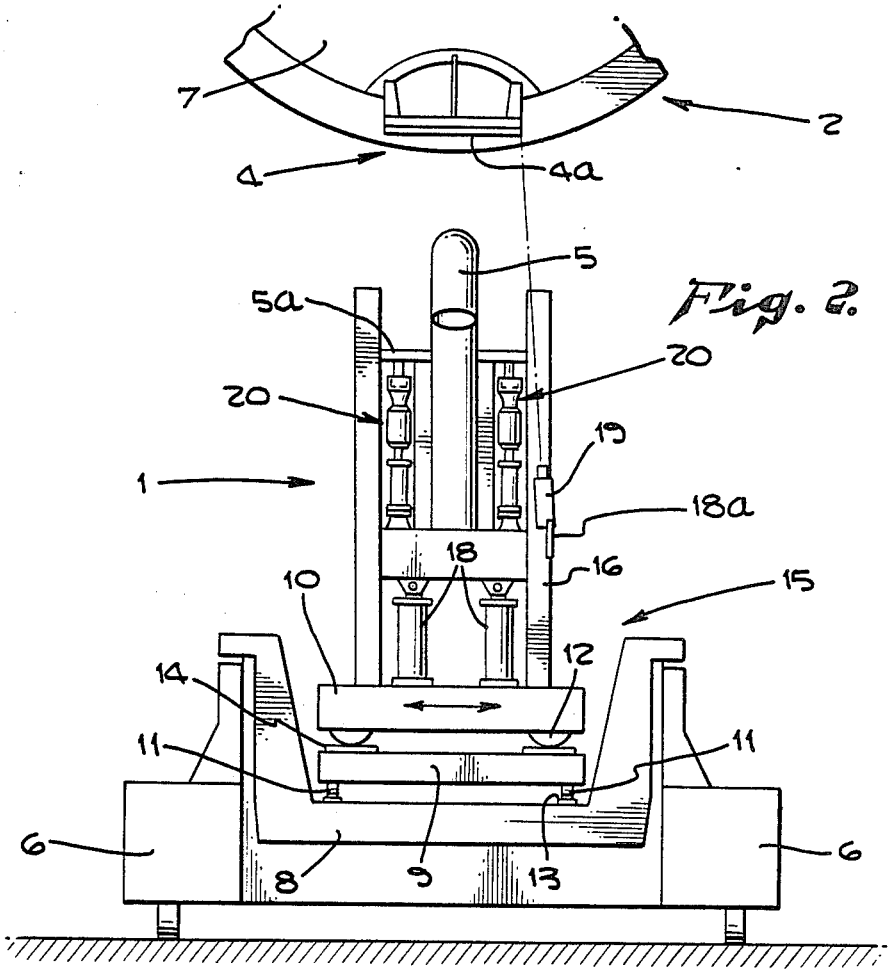
Fig. 2.

APPARATUS FOR MOUNTING A SIPHON TAPPING TUBE ONTO A CONVERTER VESSEL

BACKGROUND OF THE INVENTION

The present invention relates to an apparatus for mounting a siphon tapping tube onto a converter vessel, and in particular, to one used in the connecting or disconnecting operation for mounting or dismounting a siphon tapping tube on or from the tap hole mounting part of a converter vessel.

The surface of the molten metal or alloy in a converter has a floating cover of slag. When the converter is tilted to tap the molten metal from the tap hole, and in particular at the end of tapping, the slag tends to run out together with the molten metal. As it is not desirable to allow the slag to mix in the molten metal, a variety of schemes have been tried. Such contrivances include a separate tapping apparatus which is described in U.S. Pat. No. 4,274,622. This apparatus uses the siphon tapping method, and a bent tap passage is provided in a plane which crosses the horizontal plane when the converter is in its tapping position. The tap passage is so shaped and arranged that the static pressure of that portion of the molten metal which has remained in the tap passage after the molten bath has been discharged is kept in balance with the static pressure of the slag following the flow of the molten metal to prevent the discharge of slag out of the tap passage.

The above-mentioned bent tap passage is the siphon type converter tap hole pipe, and this tap hole pipe is mounted on the tap hole pipe mounting part of the converter. The siphon type tap hole pipe is composed of a steel tube with an inner refractory lining. As the refractory lining is worn down by the passage of molten metal, it is necessary to frequently dismount and mount the tap hole pipe from and on the converter vessel for repairs. The portions of the converter near the tap hole experience secular change due to, for example, heat load of the molten metal. This also applies to the repaired siphon tapping tube, resulting in dimensional errors between two objects. Furthermore, the converter vessel can be rotated clockwise and counterclockwise through an angle of 360° by the converter tilting unit, and its positioning accuracy is such that a small error is always present in the halt position of the center of the tap hole mounting part of the vessel. Accordingly, it is necessary to align the siphon tapping tube and the tap hole mounting part of the converter whenever the tap hole pipe is to be mounted on the converter. In addition, since the dismounting and mounting operations of the siphon tapping tube must be completed within a limited time in converter operation, the accuracy and rapidness of the operations are desired.

The siphon tapping tube and the tap hole mounting part are generally arranged to be connected by their respective flanges and bolts and nuts. However, this connection poses problems such that many man-hours are required to align every bolt holes of the flanges, and that many man-hours are required to tighten all bolts and nuts. These problems of man-hour requirement resulting from the use of bolts and nuts are also experienced when the siphon tapping tube is dismounted from the converter vessel.

Accordingly, it is indispensible to quickly carry out the above-mentioned mounting and dismounting operations, and to assure easy execution of the operations, for the practical application to the commercial converters. Such an arrangement has been realized by the connecting system of the siphon tapping tube proposed in Japanese utility model provisional pub. No. SHO-57-154750. The system reduces the work load of the mounting and dismounting of the siphon tapping tube onto and from the converter by means of a hoist or a crane in front of the converter.

However, even if the above-mentioned connecting system is used, it still requires about 45–60 minutes to perform mounting and dismounting. During the time, the converter operation must be interrupted. Hence much more quickening of the operation is required. Some operations such as mounting or dismounting the siphon tapping tube, being a heavy object, on or from the converter vessel by means of a crane in front of the converter having inherent problems of lower efficiency and safety. Improvement of such points are also required.

SUMMARY OF THE INVENTION

The present invention was made to solve the above-mentioned problems. It is intended to provide an apparatus for mounting a siphon tapping tube onto a converter vessel, which significantly reduces the time required for mounting and dismounting the siphon tapping tube and minimizes the time of interruption of the converter operation, and also allows remote control of the above-mentioned mounting and dismounting operations of the converter tap hole pipe for better work efficiency and higher safety.

The apparatus of the present invention mounts the siphon type tap hole pipe on the vessel and removes the tap hole pipe from the vessel in a position beneath the converter vessel. With this arrangement, it is not necessary to use a crane in front of the converter and the operation of other converters is not affected. Moreover, as the siphon type tap hole pipe can be positioned properly on the apparatus for mounting a tap hole pipe onto a converter vessel before bringing the apparatus to the point beneath the vessel, the time required from alignment to connection can be reduced significantly. It will takes only 5–6 minutes in comprison with 45–60 minutes of the conventional arrangement. The use of a ladle car results in an inexpensive apparatus. As the apparatus can be remotely operated by means of a TV camera, the workers are protected from falling adherents, etc.

Preferred embodiments of the invention are explained below with reference to the accompanying drawings wherein:

BRIEF DESCRIPTION OF THE DRAWINGS

FIG. 2 is a side view of the apparatus; and

FIG. 3 is a schematic diagram showing the tilted position of the converter during the operations of mounting and dismounting the siphon tapping tube.

DETAILED DESCRIPTION OF THE PREFERRED EMBODIMENT

Figure 1:
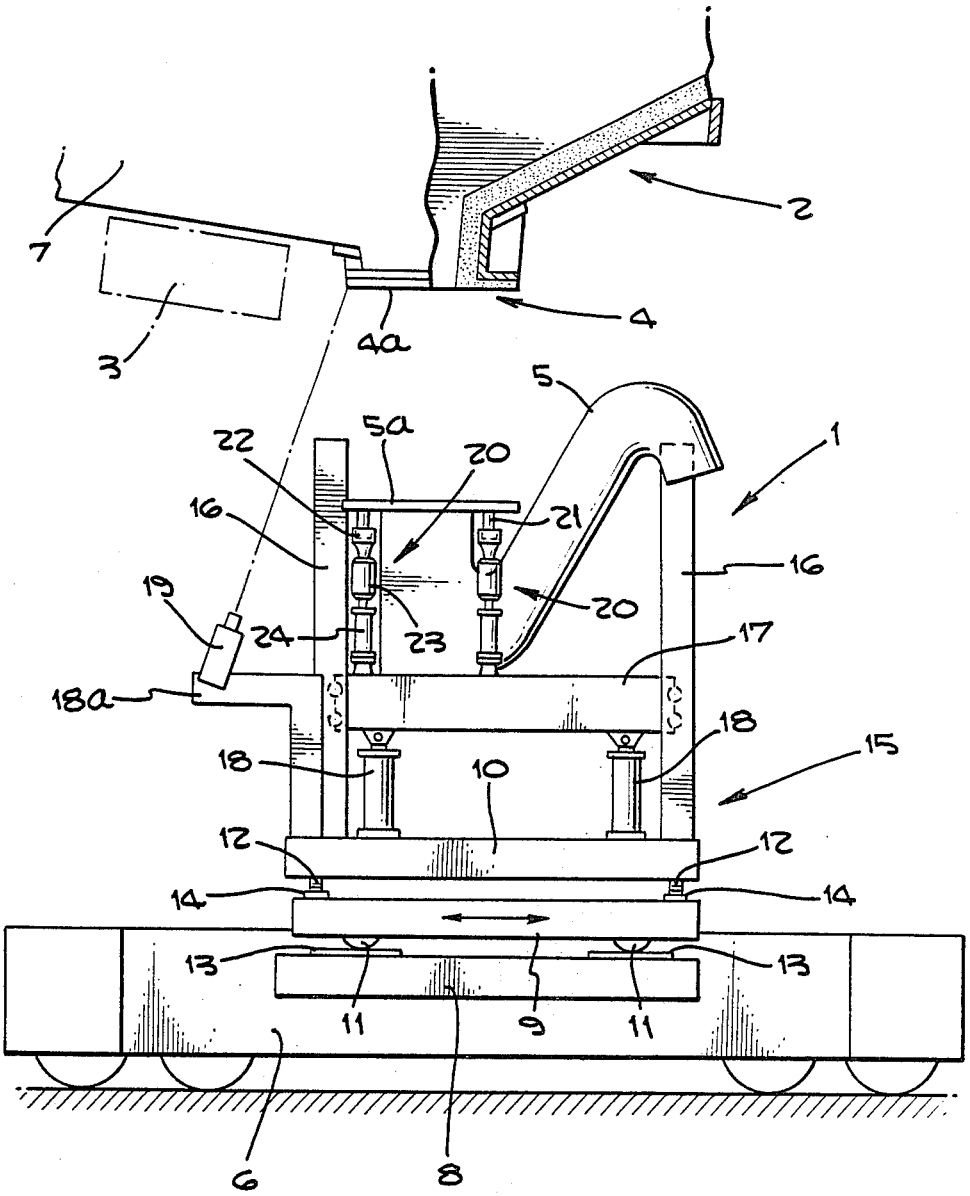
FIG. 1 is a schematic front view of an apparatus for mounting a siphon tapping tube onto a converter vessel according to the present invention.

The characteristics of the apparatus for mounting a siphon tapping tube onto a converter vessel according to the present invention will be described below with reference to FIG. 1. A lower car 9 and an upper car 10 are provided on a ladle car 6 which travels beneath a vessel 7 of a converter 2, said lower car being capable of travelling in the direction of the travel of the ladle car, and said upper car being capable of travelling in the direction perpendicular to that of the ladle car. A loading table 17 is mounted on the upper car 10, said table being guided by a vertical support frame 16 and being capable of moving up and down with a siphon tapping tube 5 placed on the table. Bolt tightening and untightening units 20 are mounted on the loading table 17 in the positions corresponding to the respective bolt hole set positions of a flange part 5*a* of the siphon tapping tube 5, said bolt tightening and untightening units being capable of receiving mounting bolts 21. Furthermore, a TV camera 19 for remote control is provided on said upper car 10, said TV camera allowing the operator to monitor the tap hole mounting part 4.

In the following, an apparatus for mounting a siphon tapping tube onto a converter vessel according to the present invention will be described with reference to drawings of its one embodiment. FIG. 1 is a front view showing the apparatus for mounting a siphon tapping tube onto a converter vessel 2 and its relation with a converter 2. FIG. 2 is a side view of the apparatus. In both figures, the converter 2 is in a tilted position indicated by the phantom line FIG. 3. A tap hole mounting part 4, is facing downward, and a flange face 4*a*, which is to be connected with a siphon tapping tube 5, is kept in a horizontal position.

The arrangement is such that a ladle car 6 can normally travel beneath the converter 2, and the apparatus 1 for mounting a siphon tapping tube 5 mounted on the car can be brought into a position directly beneath the vessel 7. The reason for the arrangement of bringing the apparatus 1 for mounting the siphon type tap hole pipe 5 onto the vessel to a position beneath the vessel 7 by means of the ladle car 6 is as follows: From the viewpoint of space around the converter, there are four possible places, in front of the converter, above the converter, behind the converter, and beneath the converter, where the siphon type tap hole pipe 5 can be mounted onto the tap hole mounting part 4 of the converter 2. The use of the place in front of the converter, however, requires exclusive use of a crane in front of the converter, and may hinder the operation of other converters, and the aligning work may become complex. In the case of the position above the converter, it is necessary to shift the hood of the converter waste gas treating equipment. Moreover, it is not possible to replace the siphon tapping tube 5 in the position above the converter within a short time. There is no sufficient space behind the converter, and a crane is not usually available there in typical BOF shop. On the other hand, in a place beneath the converter, there is an advantage that the siphon tapping tube 5 can be brought in and out by using the track for ladle cars 6. Furthermore, the use of an existing ladle car may reduce the cost of the apparatus.

A lower car 9 and an upper car 10 are provided on said apparatus for mounting a siphon tapping tube onto a converter vessel 2, said cars being capable of travelling, on the fixed frame 8 mounted on said ladle car, in two directions. In the present embodiment, the lower car 9 can travel in the longitudinal direction which coincides with the travel direction of the ladle car 6, and the travel is within a range in which the misalignment between the tap hole pipe and the tap hole mounting part 4 due to the positioning precision of the ladle car 6 can be compensated. In the same manner as the lower car 9, the upper car 10 can travel as shown in FIG. 2, from side to side or in the direction which is perpendicular to the direction of the travel of the lower car 9. The travel is within a range in which the misalignment in the direction of the converter trunnion axis due to secular change of the shell of the vessel can be compensated. Accordingly, the respective cars 9, 10 are provided with rollers 11, 12. Liners 13, 14, which serve as tracks of the lower car 9 and the upper car 10 respectively, are provided on the tops of the fixed frame 8 and the lower car 9. Furthermore, telescopic mechanisms such as hydraulic cylinders (not illustrated) are provided to shift the lower and upper cars 9, 10 and in turn to make alignment. These constituents form a means 15 for moving the siphon tapping tube 5, said means being capable of aligning the center of the siphon tapping tube 5 to the center of the tap hole mounting part 4.

A vertical support frame 16 is provided on the upper car 10, and a loading table 17 being movable up and down is mounted within this support frame 16. The loading table 17 is arranged to move up or down with the siphon type tap hole pipe 5 placed on the table. In the figure, lifting cylinders 18 are illustrated as means for raising or lowering the loading table 17. However, a means which can wind up or unwind a wire suspending the loading table 17 may be used. After all, it is sufficient to arrange the loading table 17 so that it can be lifted or lowered while holding the table top horizontal. The siphon tapping tube 5 is placed on the loading table 17 beforehand, and its flange portion 5*a* is kept horizontal. On the other hand, the tap hole mounting part 4 of the converter 2 is held in a position in which its flange part 4*a* is horizontal. Thus it is so arranged that this flange part 4*a* and the above-mentioned siphon tapping tube 5 can be connected by aligning them and lifting the loading table 17.

For the convenience of connection of the above-mentioned flange parts 4*a* and 5*a*, a TV camera 19 is mounted on a mounting arm 18*a* which hangs over from the upper car 10 of the apparatus for mounting a tap hole pipe onto a converter vessel 2, the TV camera being one for remote control and capable of observing the tap hole mounting part 4. This TV camera 19 is provided to allow the operation of the apparatus for mounting a tap hole pipe onto a converter vessel 2 without any workers entering the position beneath the vessel of the converter 2. The TV camera is directed towards the tap hole mounting part 4, and transmits the view of the tap hole mounting part 4, and the vicinities of the tap hole mounting part 4. The flange part 5*a* of the siphon tapping tube 5 and the flange part 4*a* of the tap hole mounting part 4 can be aligned with each other by shifting the above-mentioned upper car 10 and the lower car 9 and raising the loading table 17.

Said siphon type tap hole pipe 5 is arranged to be loaded in the same position on the loading table 17. Bolt tightening and untightening units 20 are provided at the respective bolt hole positions (not illustrated) of the flange part 5*a* of the siphon type tap hole pipe 5 being placed in said position. Each bolt tightening and untightening unit 20 has a receiving part 22, said receiving part being capable of receiving a mounting bolt 21 at the top end, a rotational drive part 23, and a lifting means 24. In the embodiment, two units on one side and two units on the other side, a total of four units are provided. The flange part 4*a* of the tap hole mounting part 4 has bolt holes corresponding to the head of the mounting bolts 21. While monitoring with the TV camera 19, the operator aligns the flange part 4a and the flange part 5a. The operator effects lifting operation of mounting bolts 21 by lifting means 24. After the operator effects rotating nuts attached to mounting bolts 21 to connect both flange parts 4a and 5a. On the other hand, the removal of the siphon type tap hole pipe 5 from the vessel 7 of the converter 2 can be effected by reversing the order of the operation. It should be noted that the bolt tightening and untightening units 20 are not limited to those illustrated in the figures. The necessary constituents of the unit are a mounting bolt receiving part, a rotational driving part, and a lifting means. Furthermore, other types of mounting bolts may be used.

If an arrangement is made so that the siphon type tap hole pipe 5 is always loaded in one specified position on the loading table 17, the siphon tapping tube 5 and the tap hole mounting part 4 can be aligned by operating the cars so as to sight a references point on the converter 2 by the TV camera for remote control 19, said camera being fixed at a certain angle. Then the siphon type tap hole pipe 5 can be brought to mate the tap hole mounting part 4 by raising the loading table 17. Thus the remote operation may be simplified.

The apparatus for mounting a tap hole pipe onto a converter vessel 1 of the above-mentioned configuration thus is capable of connecting and disconnecting of the siphon tapping tube 5, being a heavy object, and the tap hole mounting part 4 of the converter 2. The siphon tapping tube 5 is loaded on the loading table 17 in a preparation position, and the apparatus for mounting a tap hole pipe onto a converter vessel 2 on the ladle car 6 is brought into the position beneath the converter 2. The siphon tapping tube 5 is kept in a position in which the flange part 5a comes to the top. When the ladle car 6 is positioned in a predetermined position beneath the vessel 7, the TV camera 19 monitors the view around the tap hole mounting part 4 of the converter 2, and the image taken by this camera 19 is shown in the operator room. While monitoring the image, the operator shifts the lower car 9 and the upper car 10 of the apparatus for mounting a tap hole onto a converter vessel 1. Then the loading table 17 is raised to connect both flange parts 4a and 5a as explained above.

To remove the siphon tapping tube, the above-mentioned operation is made with the loading table holding no tap hole pipe. The mounting bolts are rotated in the direction reverse to that for connection to separate both flange parts from each other. The siphon tapping tube 5 is removed from the vessel 7 and is placed on the loading table 17. After that, the ladle car 6 is withdrawing from the position beneath the vessel of the converter 2.

What is claimed is:

1. An apparatus for mounting a siphon tapping tube onto a tap hole mounting part of a converter vessel, which is characterized in that:

a lower car and an upper car are placed on a ladle car which travels beneath a converter vessel in a given direction of travel, said lower car and upper car being capable of travelling in the direction of the travel of the ladle car and in the direction perpendicular to that of the travel of the ladle car, respectively, a loading table mounted on said upper car, said loading table being guided by an upright support frame and being capable of moving upward and downward with a siphon tapping tube on the table, and bolt tightening and untightening units are provided on the loading table in positions corresponding to the respective bolt hole set positions in the flange of the siphon tapping tube, said bolt tightening and untightening units being capable of receiving mounting bolts.

2. An apparatus for mounting a siphon tapping tube onto a tap hole mounting part of a converter vessel as in claim 1 further comprising the provision of:

a TV camera for remote controlling is provided on said upper car, said TV camera allowing the operator to monitor the tap hole mounting part.

* * * * *

UNITED STATES PATENT AND TRADEMARK OFFICE

CERTIFICATE OF CORRECTION

PATENT NO. : 4,776,083

DATED : Oct. 11, 1988

INVENTOR(S) : Manabu Sakamoto, Satoshi Tatsuta, Akira Murata, Natsuki Namura, Shigeki Tamada, Yoshinori Kawasaki, Norio Misaki It is certified that error appears in the above-identified patent and that said Letters Patent are hereby corrected as shown below: Title page:

[73] Assignee: Kawasaki Jukogyo Kabushiki Kaisha and Kawasaki Steel Corporation, both of Kobe, Japan. (part interest)

Signed and Sealed this

Fourth Day of April, 1989

*Attest:*

*Attesting Officer*

DONALD J. QUIGG

*Commissioner of Patents and Trademarks*